US007147395B2

(12) United States Patent
Weiss et al.

(10) Patent No.: US 7,147,395 B2
(45) Date of Patent: Dec. 12, 2006

(54) APPLICATOR DEVICE

(75) Inventors: Willy Weiss, Altdorf (DE); Dieter Schiller, Rosstal (DE)

(73) Assignee: Schwan-Stabilo Cosmestics GmbH & Co. KG, Heroldsberg (DE)

( * ) Notice: Subject to any disclaimer, the term of this patent is extended or adjusted under 35 U.S.C. 154(b) by 0 days.

(21) Appl. No.: 10/982,202

(22) Filed: Nov. 4, 2004

(65) Prior Publication Data

US 2005/0214063 A1 Sep. 29, 2005

(30) Foreign Application Priority Data

Mar. 23, 2004 (DE) ..... 20 2004 004 567 U

(51) Int. Cl.
*B05C 11/00* (2006.01)

(52) U.S. Cl. ..... 401/266; 401/265; 401/261; 401/197; 401/138; 401/139

(58) Field of Classification Search ..... 401/266, 401/265, 261, 196, 197, 284, 137–139
See application file for complete search history.

(56) References Cited

U.S. PATENT DOCUMENTS

| | | | | |
|---|---|---|---|---|
| 2,743,469 | A | 5/1956 | Ditch | |
| 4,223,999 | A * | 9/1980 | Wells | 401/266 |
| 4,244,074 | A | 1/1981 | Barcikowski et al. | |
| 5,199,808 | A | 4/1993 | Gueret | |
| 6,238,117 | B1 * | 5/2001 | Griebel et al. | 401/148 |
| 6,309,128 | B1 * | 10/2001 | Griebel et al. | 401/266 |
| 6,336,763 | B1 * | 1/2002 | Losier et al. | 401/266 |
| 6,357,945 | B1 | 3/2002 | Losier et al. | |
| 6,616,019 | B1 | 9/2003 | D'Alessio et al. | |
| 2003/0015557 | A1 | 1/2003 | D'Alessio et al. | |

FOREIGN PATENT DOCUMENTS

| | | |
|---|---|---|
| CH | 545 692 | 2/1974 |
| DE | 500 183 | 6/1930 |
| DE | 198 58 410 | 6/2000 |
| GB | 392909 | 5/1932 |

OTHER PUBLICATIONS

Merriam-Webster Online Dictionary, 2 pages, dated Mar. 10, 2006.*

* cited by examiner

*Primary Examiner*—Khoa D. Huynh
(74) *Attorney, Agent, or Firm*—Bachman & LaPointe, P.C.

(57) ABSTRACT

An applicator device for a liquid, pasty, gel-like, wax-like or powder product comprising a working region having a metal mesh, wherein the metal mesh has a weave with twill bonds.

2 Claims, 1 Drawing Sheet

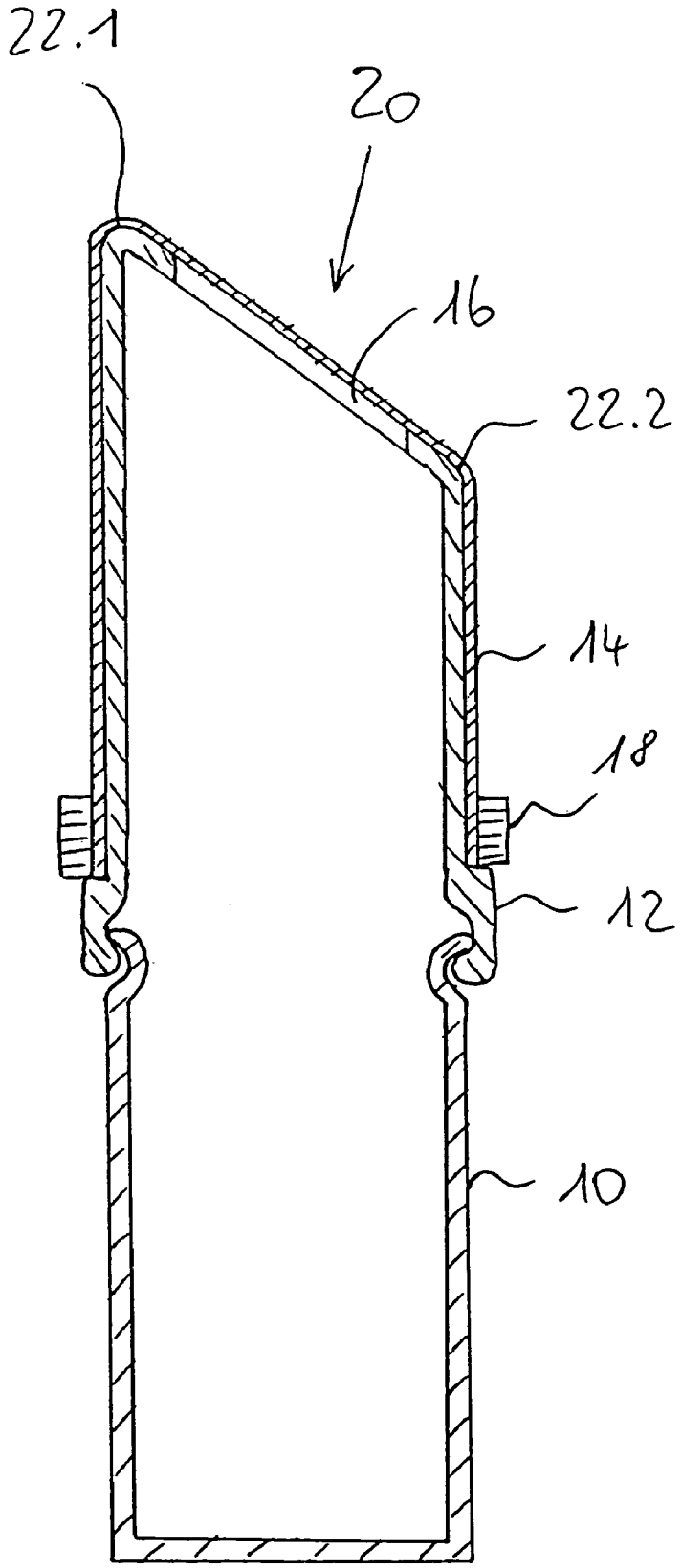
22.1
20
16
22.2
14
18
12
10

APPLICATOR DEVICE

BACKGROUND OF THE INVENTION

The invention concerns an applicator device for a liquid, pasty, gel-like, wax-like or powder product, comprising a working region having a metal mesh.

An applicator device of the kind set forth above is known, for example from French patent No 925 899.

The known applicator device however is not satisfactory from the haptic point of view. In addition, it is not possible with the known applicator device for the product which is to be applied to be satisfactorily distributed over a surface to which it is to be applied.

The object of the invention is to develop the applicator device of the kind set forth in the opening part of this specification, in such a way that it is improved in terms of the haptic aspect and also in regard to distribution of the product.

SUMMARY OF THE INVENTION

In accordance with the invention, in an applicator device of the kind set forth in the opening part of this specification, the object is attained wherein the metal mesh has a weave with a twill bond.

More specifically it has surprisingly been found that a metal twill weave, in contrast to other metal meshes, produces an excellent tactile haptic feel on the skin and that it is possible to achieve excellent distribution of relevant products on the skin by means of a metal twill weave.

In accordance with the invention a mesh width of the weave is preferably between 0.02 mm and 0.2 mm, further preferably between 0.05 mm and 0.09 mm. That dimensioning is advantageous on the one hand in respect of the haptic aspect and also in respect of the distribution properties. In addition the preferred mesh width entails advantages in particular when the product is to be conveyed through the meshes into the working region.

Further advantages are enjoyed when the mesh comprises a wire of a thickness of between 0.02 mm and 0.15 mm, preferably between 0.04 mm and 0.1 mm.

In accordance with the invention the weave is preferably annealed and/or calandered, whereby application of the product takes place in a particularly soft and gentle fashion.

The weave in accordance with the invention is preferably under tension. That has advantages in particular in regard to the haptic aspect and also in regard to the uniformity of application of the product.

In that respect in accordance with the invention the applicator device preferably has a carrier on which the weave is taut.

In this connection it is further preferred that, in that region which carries the tension of the weave, the carrier has a modulus of elasticity of at least 800 $N/mm^2$ and preferably less than 1100 $N/mm^2$, particularly preferably 1000 $N/mm^2$ or less. That configuration is of great advantage in particular when the weave is applied to the carrier by deep drawing.

In accordance with the invention, for the same reason it is preferred that, in that region which carries the tension of the weave, the carrier is of a wall thickness of at least 0.3 mm and preferably less than 4 mm, particularly preferably less than 1.5 mm, in particular 0.8 mm or less, more specifically measured transversely with respect to the tensioning direction.

Particularly having regard to the fact that the weave is fitted over the carrier, the carrier in accordance with the invention is preferably of a contour which is arcuate in section, in a region delimiting the working region. That reliably prevents damage to the weave (for example by virtue of tearing) when it is being fitted over the carrier.

In a further preferred feature in a region delimiting the working region the carrier has a bevel, preferably in the range of between 0.15 mm and 2.5 mm. Such a bevel is particularly advantageous in regard to the fact that the product is to be uniformly applied and distributed. More specifically, without such a bevel, there is the danger that the applicator device pushes the product in front of it, for example when rubbing it in, instead of distributing it uniformly.

As already indicated above in accordance with the invention it is particularly preferred that the weave is turned inside out over the carrier and a holder holds the weave on the carrier. That affords an overall particularly simple construction.

Particularly in the case of a rotationally symmetrical carrier the holder is preferably embodied in the form of a ring.

Finally in accordance with the invention it is particularly preferred for the weave to comprise a wire with a nickel content of between 2% and 16%. Such a nickel content is advantageous in particular in regard to the deep drawing operation already referred to above.

BRIEF DESCRIPTION OF THE DRAWINGS

The invention will be described in greater detail hereinafter by means of a preferred embodiment with reference to the accompanying drawing in which:

The single FIGURE is a diagrammatic view in longitudinal section of an applicator device according to a particularly preferred embodiment of the invention.

DETAILED DESCRIPTION

The applicator device illustrated in the drawing includes a bottle-like container 10 for receiving a product which is to be applied, in this case for receiving lip rouge in pasty form. Fitted on the container 10 is a carrier 12 on to which a metal twill weave 14 is fitted under tension. The weave 14 is held under tension on the carrier 12 by a ring 18. The tension is a tension in the direction of the main plane of the weave 14, which results from a deep drawing operation for fitting the weave 14 over the carrier.

As is conventional in relation to lipsticks, the applicator device illustrated in the drawing has a flattened working region 20 which is angled with respect to the longitudinal axis. The edge of the carrier 12, which delimits the working region 20 and which is identified in the drawing by references 22.1 and 22.2 is rounded off so that no damage occurs when the weave 14 is being fitted over the carrier. In addition it is bevelled.

The applicator device illustrated in the drawing is produced as follows: a metal twill weave is calandered and fitted over the carrier 14 by a deep drawing operation. Thereupon the ring 18 is applied in order to maintain the tension resulting from the deep drawing operation. That provides that the weave 14 remains smooth in particular in the working region 20. Any folds which are caused by the deep drawing operation are concealed by the ring 18.

The container 10 is elastic. When it is compressed cosmetic product disposed in the interior of the container, that is to say for example lip rouge, is conveyed into the working region through an outlet opening 16 and the meshes of the weave 14. The lip rouge can be distributed on the skin by means of the working region in a particularly desirable manner or a product with a dermatological action can be rubbed in.

The features of the invention disclosed in the foregoing description, the claims and the drawing can be essential for implementing the invention in its various embodiments, both individually and also in any combinations.

The invention claimed is:

1. A cosmetic applicator device for applying a cosmetic product to the skin comprising a working region (20) having a metal mesh, wherein the metal mesh has a weave (14) with twill bonds to provide a tactile haptic feel on the skin during cosmetic product application further including a carrier on which the twill weave is tensioned, wherein the carrier (12) in that region which carries means for tensioning the weave (14) has a wall thickness of at least 0.3 mm and less than 4 mm.

2. A cosmetic applicator device for applying a cosmetic product to the skin comprising a working region having a metal mesh, wherein the metal mesh has a weave with twill bonds to provide a tactile haptic feel on the skin during cosmetic product application, further including means for holding the weave (14) under tension on a carrier (12) in a direction of the main plane of the weave (14), wherein the carrier (12), in that region which carries the tension of the weave (14), has a modulus of elasticity of at least 800 $N/mm^2$ and less than 1100 $N/mm^2$.

* * * * *